United States Patent [19]

Cilderman et al.

[11] Patent Number: 4,793,441

[45] Date of Patent: Dec. 27, 1988

[54] ELEVATOR CAR SYSTEM WITH THREE GUIDE RAILS

[75] Inventors: Janis Cilderman, West Simsbury; Stuart B. Spence, Simsbury, both of Conn.

[73] Assignee: Otis Elevator Company, Farmington, Conn.

[21] Appl. No.: 110,408

[22] Filed: Oct. 20, 1987

[51] Int. Cl.[4] ..... B66B 7/02

[52] U.S. Cl. ..... 187/95; 182/141

[58] Field of Search ..... 187/1 R, 95, 94; 104/242; 182/63, 141

[56] References Cited

U.S. PATENT DOCUMENTS 3,252,547 5/1966 Hornedo ..... 187/95

3,856,117 12/1974 Solymos ..... 187/95

*Primary Examiner*—Joseph J. Rolla

*Assistant Examiner*—Kenneth Noland

[57] ABSTRACT

The elevator car is guided in its movement through the hoistway by the two conventional guide rails positioned one on each side of the car, and also by a third guide rail positioned on one side of the car adjacent one of the car doors. The blade of the third guide rail is parallel to the sides of the car, and is engaged by a pair of guide rolls which are mounted on a beam extending out from under the car floor. The third guide rail is mounted in the hoistway on the bracket beams which secure the counterweight guide rails in place. The purpose of the third guide rail is to prevent lateral oscillation of the car as it moves through the hoistway.

4 Claims, 2 Drawing Sheets

ELEVATOR CAR SYSTEM WITH THREE GUIDE RAILS

DESCRIPTION

TECHNICAL FIELD

This invention relates to a guide system for guiding movement of elevator cars in hoistways, and more particularly to an elevator guide system using three guide rails to stabilize the car against lateral oscillation.

BACKGROUND ART

Elevator cars are guided in their movement through hoistways by guide rails which are mounted in the hoistways. Conventionally, there will be two sets of three guide rolls or wheels mounted on each side of the car, one set projecting laterally from each side of the floor thereof and another set projecting laterally from each side of the roof thereof. The guide rails, which are T-shaped rails, are positioned with their stems, or blades, extending toward the sides of the car. The three guide rolls on the sides and the face of the rail blades roll over the rails as the car moves up and down in the hoistway. Ordinarily the two side guide rails and their associated rollers are sufficient to provide a smooth and steady ride for the car. In certain instances, however, when the elevator cars are unusually deep, such as is the case with a car which has passenger doors on both ends of the car, the length of the car can cause the car to oscillate sideways about the two guide rails, especially when the car moves at high speeds in the hoistway. This oscillation, or fishtailing, is unpleasant to experience and can alarm passengers in the car.

DISCLOSURE OF INVENTION

This invention provides a solution for the problem of lateral oscillation of elevator cars of unusual depth. A third guide rail is installed in the hoistway on one side of the car adjacent to a side corner of the car. The third rail will be fastened to the counterweight guiderail brackets by means of auxiliary bracket clamps. The third guide rail will be positioned with its blade parallel to the side wall of the car, and perpendicular to the blades of the other two car guide rails. The third guide rail blade is engaged by a pair of auxiliary guide rolls which are mounted on a beam which projects outwardly from beneath the car floor at a corner thereof of the side wall adjacent to one of the car door walls. Engagement of the third guide rail by the auxiliary guide rolls prevents the car from oscillating about the two primary guide rails. Securing the auxiliary guide rolls to the floor of the car provides the sensation of a smoother ride to the passengers in the car.

It is therefore an object of this invention to provide an improved elevator guide rail system which serves to prevent lateral oscillation of the elevator car in the hoistway as the car moves up and down in the hoistway.

It is a further object of this invention to provide a guide rail system of the character described which can be retrofitted onto existing elevator systems.

It is an additional object of this invention to provide a guide rail system of the character described which utilizes an auxiliary guide rail and cooperating auxiliary guide rolls to steady the car against lateral oscillation.

It is another object of this invention to provide a guide rail system of the character described wherein the auxiliary guide rail has its blade perpendicular to the blades of the conventional guide rails, and the auxiliary guide rail and guide rolls are operable to brace a corner area of the car to prevent the lateral swaying of the car.

These and other objects and advantages of this invention will become more readily apparent from the following detailed description of a preferred embodiment thereof when taken in conjunction with the accompanying drawings in which:

BEST MODE FOR CARRYING OUT THE INVENTION

Figure 1:
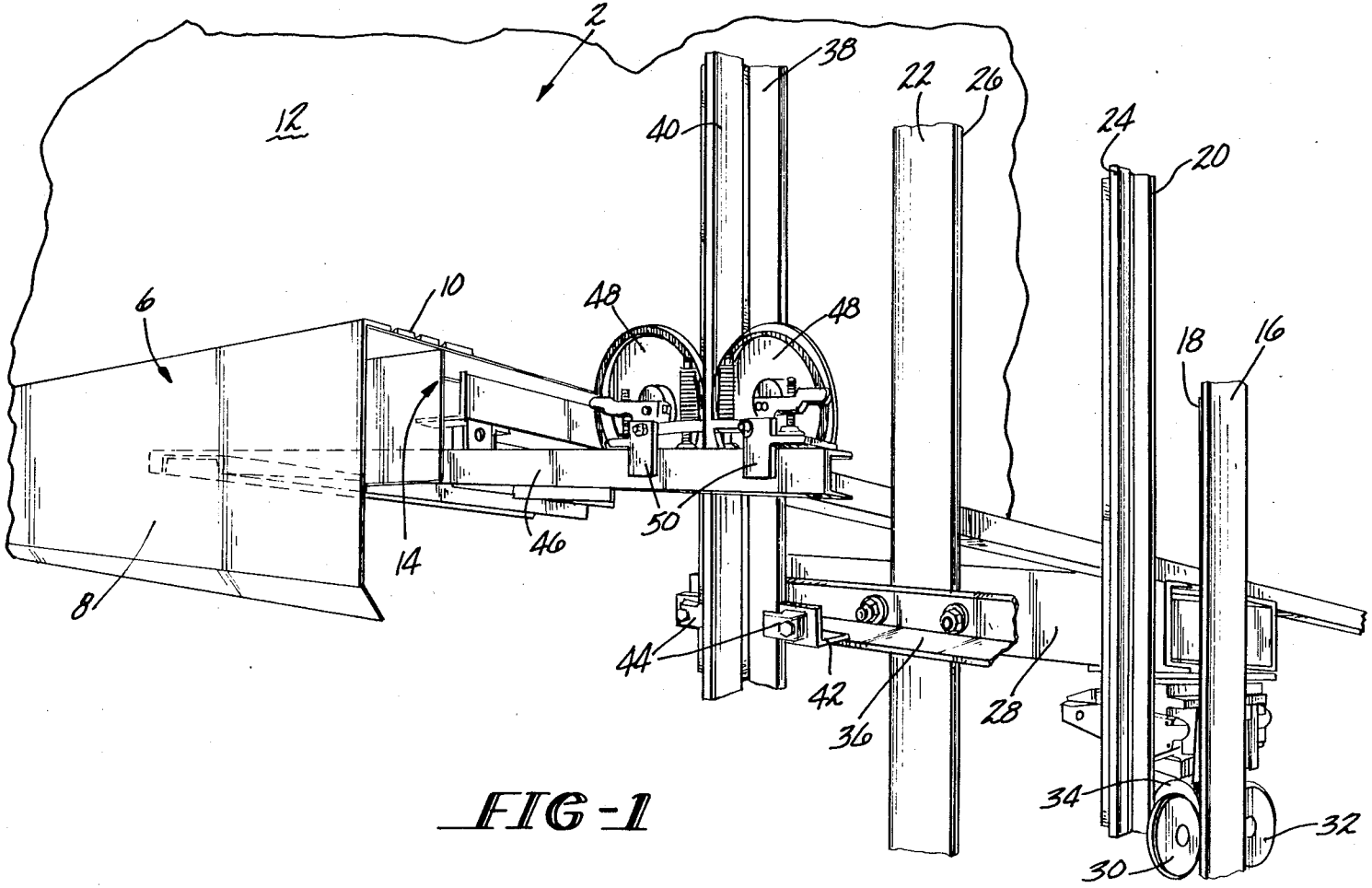
FIG. 1 is a fragmented perspective view of an elevator system which is equipped with the car guiding system of this invention.

Referring to the drawings, there is shown a preferred embodiment of the elevator car guiding system of this invention. The elevator car is denoted generally by the numeral 2, and it is mounted for movement in the hoistway which is denoted generally by the numeral 4. The car 2 may be one which has passenger doors at both of its ends, so that one of the doors would be located at the end 6 of the car 2. The plate 8 denotes a sill and toeguard which depends down from the floor 10 of the car 2 inside of the hoistway. The wall 12 of the car 2 is a side wall with the side wall nearest the viewer, as seen in FIG. 1, having been removed for purposes of clarity. The corner 14 is the vertical corner where the door end 6 and nearest side wall of the car 2 meet. The car 2 is normally guided by a pair of guide rails 16 which are disposed one on each side of the car. The guide rails 16 are T-shaped in cross section, and the stem portion 18, called the "blade", of each rail 16 extends toward the opposite sides of the car 2. The standard guide rails 16 are positioned in the hoistway 4 about midway between the ends of the car 2, and are secured to the walls of the hoistway 4 by brackets (not shown). Mounted beneath the floor 10 of the car 2 is a composite beam 28 which carries a set of three guide rolls 30, 32 and 34 which engage the sides and the face of the guide rail blade 18. A similar arrangement is disposed on the opposite side of the car 2. The rolls 30, 32 and 34 thus combine to guide and steady the car 2 as it moves up and down in the hoistway.

Figure 2:
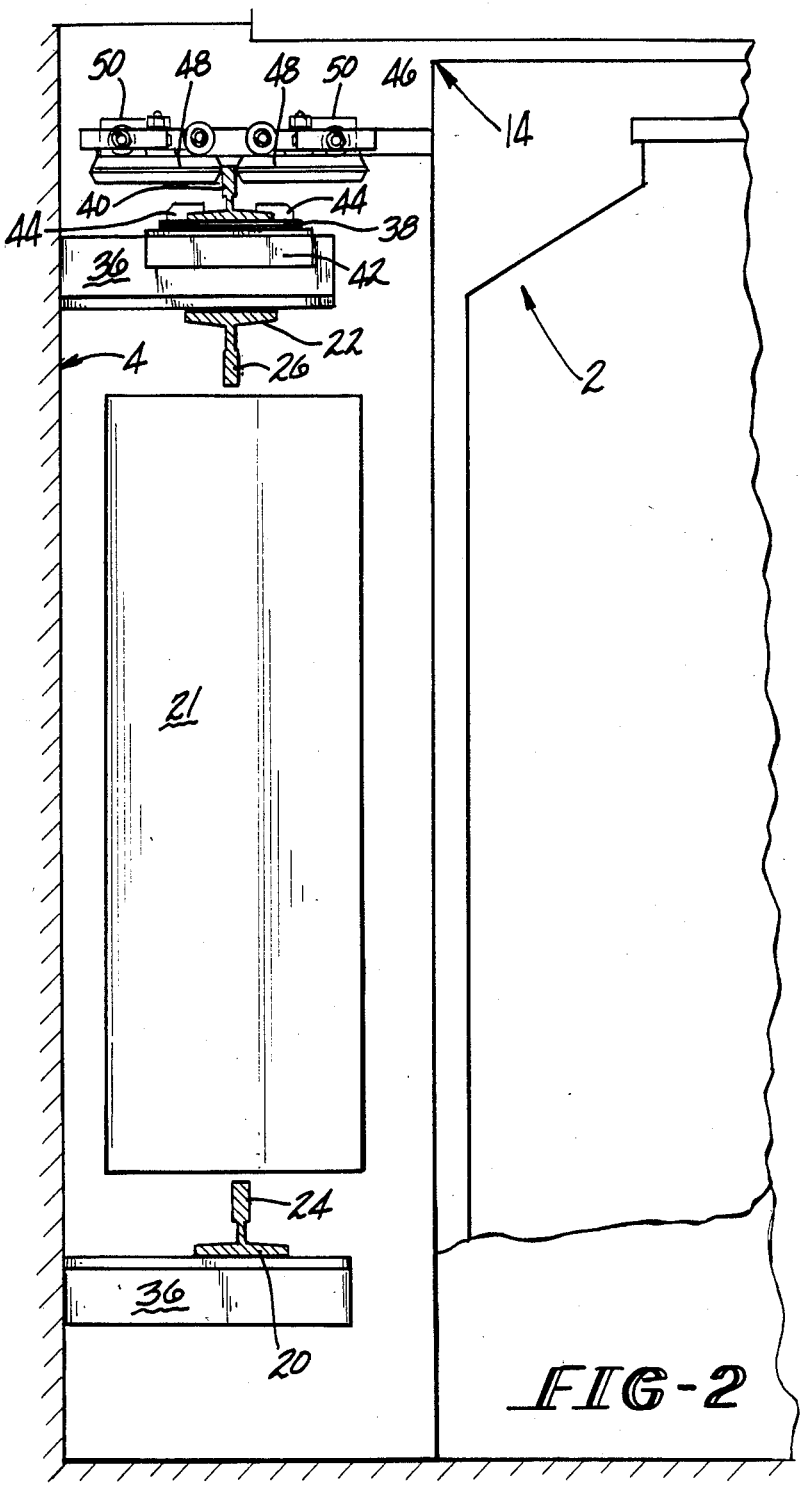
FIG. 2 is a fragmented top plan view of the guiding system of FIG. 1.

Also disposed in the hoistway 4 are a pair of counterweight guide rails 20 and 22. The blades 24 and 26 of the counterweight guide rails 20 and 22 face each other and serve to guide movement of a counterweight frame 21, (see FIG. 2) in the hoistway 4. The counterweight guide rails 20 and 22 are secured in the hoistway 4 by brackets 36 which are tied into the side wall of the hoistway 4, as shown in FIG. 2. There will be a set of the brackets 36 at about 12 foot intervals throughout the hoistway 4. It will be noted from FIG. 1 that cars which are relatively deep, i.e. are longer from front to back than from side to side, may have a tendency to rock laterally about the pivot point formed by the guide rails 16 and guide rolls, 30, 32, 34. This tendency may be heightened when the cars operate at relatively high speeds, as for example, speeds of about sixteen feet per minute or so.

In order to neutralize this tendency to sway or oscillate laterally, a stabilizer rail 38 is positioned in the hoistway 4 with the blade 40 of the stabilizer rail 38 being parallel to the side walls of the car 2. Brackets 42 are welded or bolted to the counterweight rail brackets 36 and clamp assemblies 44 are used to clamp the stabilizer rail 38 to the brackets 42. The stabilizer rail 38 is thus positioned opposite the end corner 14 of the car 2. A beam 46 is secured to the underside of the car 2 and projects outwardly therefrom at the corner 14. A pair of stabilizer rolls 48 are mounted on the beam 46 and positioned to engage opposite sides of the stabilizer rail blade 40. The rolls 48 are journalled on mounts 50 which are secured to the beam 46, and are operable to oppose lateral movement of the corner 14 of the car 2 in either direction due to their engagement with the stabilizer rail blade 40. In this manner swaying of the car 21 as it traverses the hoistway will be minimized.

It will be readily appreciated that a relatively simple modification of the hardware conventionally in the hoistway, as taught by this invention, will substantially eliminate the problem of elevator car swaying, or lateral oscillating, which may occur with unusually deep elevator cars. The additional hardware is of standard design, and can be relatively easily installed in the elevator hoistway. Existing systems can be retrofitted with hardware employing this invention without undue complications.

Since many changes and variations of the disclosed embodiment of the invention may be made without departing from the inventive concept, it is not intended to limit the invention otherwise than as required by the appended claims.

I claim:

1. A system for guiding movement of an elevator car in a hoistway, said system comprising:

(a) an elevator car having opposed side walls; a pair of end walls joining said side walls at corners wherein at least one of said end walls includes a car door; and said car further having a floor;

(b) a pair of guide rails mounted in said hoistway outside of said car, each of said guide rails being located midway between said car end walls outwardly adjacent to one of said car side walls, and each of said guide rails having a blade which is perpendicular to and extends toward a respective one of said car side walls;

(c) sets of guide rolls mounted on said car, each one of said sets including individual rolls being disposed in rolling contact with a respective one of said guide rail blades whereby said guide rails and sets of guide rolls guide movement of said car through said hoistway;

(d) a single stabilizer rail mounted in said hoistway outside of said car opposite one of said car corners, said stabilizer rail having a blade which is spaced from said car and parallel to said car side walls; and (e) a pair of stabilizer rolls mounted on said car, said stabilizer rolls engaging opposite parallel side surfaces of said stabilizer rail blade to damp oscillatory movement of said car in directions perpendicular to said side walls.

2. The system of claim 1 further comprising a pair of counterweight guide rails mounted in said hoistway on the same side of said car as said stabilizer rail, said counterweight guide rails being secured to the hoistway wall by means of angle brackets projecting from the hoistway wall and clamped to the counterweight guide rails, and said stabilizer rail being secured to said angle brackets on a side thereof opposite said counterweight guide rails.

3. The system of claim 2 wherein said stabilizer rail is secured to said angle brackets by means of clamps welded to said angle brackets and clamped to said stabilizer rail.

4. The system of claim 3 wherein said stabilizer rolls are mounted on a beam which is secured to said car beneath said car floor and which extends outwardly from said car beyond said one car side wall toward said stabilizer rail.

* * * * *